US005361079A

United States Patent [19]

Yamamoto

[11] Patent Number: 5,361,079

[45] Date of Patent: Nov. 1, 1994

[54] CONNECTOR FOR INTERCONNECTING A GRID TO A GRID DRIVE IN A CHIP-IN FLUORESCENT DISPLAY PANEL

[75] Inventor: Jiro Yamamoto, Tokyo, Japan

[73] Assignee: NEC Corporation, Japan

[21] Appl. No.: 23,068

[22] Filed: Feb. 25, 1993

[30] Foreign Application Priority Data

| | | | |
|---|---|---|---|
| Mar. 4, 1992 | [JP] | Japan | 4-046504 |
| Mar. 18, 1992 | [JP] | Japan | 4-061599 |
| Mar. 18, 1992 | [JP] | Japan | 4-061600 |

[51] Int. Cl.[5] ..... G09G 3/22

[52] U.S. Cl. ..... 345/75; 313/496; 345/206

[58] Field of Search ..... 340/771, 759; 313/331, 313/496, 497, 517, 519, 520, 521; 439/59, 60, 65, 68, 629, 630; 361/400, 403, 413, 760, 764, 767; 345/47, 206, 44, 36, 64, 74, 75, 76

[56] References Cited

U.S. PATENT DOCUMENTS

| | | | |
|---|---|---|---|
| 3,819,975 | 6/1974 | Kunii et al. | 313/517 |
| 4,047,066 | 9/1977 | Kobayakawa et al. | 313/496 |
| 4,722,027 | 1/1988 | Hayakawa | 361/400 |
| 4,824,213 | 4/1989 | Morokawa | 359/54 |
| 5,235,245 | 8/1993 | Uchimura et al. | 313/496 |

FOREIGN PATENT DOCUMENTS

| | | | |
|---|---|---|---|
| 0319274 | 12/1989 | Japan | 439/59 |

*Primary Examiner*—Richard Hjerpe
*Assistant Examiner*—Chanh Nguyen
*Attorney, Agent, or Firm*—Laff, Whitesel, Conte & Saret

[57] ABSTRACT

A chip-in glass fluorescent display panel, includes a glass substrate, phosphor layers, grid elements, grid and anode driving semiconductor elements, and metal strips. A predetermined display pattern is formed on the glass substrate by using thin aluminum film wires. The phosphor layers are formed on the thin aluminum film wires. The grid elements are formed at a predetermined pitch on the phosphor layers through a predetermined space to extend parallel each other, and have rectangular flat portions formed at end portions. The rectangular flat portions are in surface contact with the surface of the glass substrate and are fixed thereto. The grid electrode terminals are composed of aluminum terminals formed on the glass substrate to be respectively located adjacent to the flat portions of the grid elements. The grid and anode driving semiconductor elements are mounted on the glass substrate and electrically connected to the grid electrode terminals, and the thin aluminum film wires, respectively. Each metal strip has first and second L-shaped pawls at a distal end thereof. The first and second pawls are respectively in contact with to the flat portion of each grid element and the adjacent grid electrode terminal.

12 Claims, 4 Drawing Sheets

CONNECTOR FOR INTERCONNECTING A GRID TO A GRID DRIVE IN A CHIP-IN FLUORESCENT DISPLAY PANEL

BACKGROUND OF THE INVENTION

The present invention relates to a chip-in glass fluorescent display panel having driving semiconductor elements incorporated in a vacuum envelope and, more particularly, to a structure for connecting a grid to a grid driving semiconductor element.

In a conventional chip-in glass fluorescent display panel having driving semiconductor elements incorporated in a vacuum envelope, each anode wire on a glass substrate is made of a thin aluminum film, and the anode wires and an anode driving semiconductor element are connected to each other by wire bonding. Since each anode wire consists of aluminum, wire bonding can be easily performed.

As shown in FIG. 6A, a grid 1 is supported on a glass spacer 3 and is fixed thereon with crystallized glass 16, thus forming a three-dimensional structure on a glass substrate 22. Each grid wire 4 made of a thin aluminum film is formed between the grid 1 and a grid driving semiconductor element 2. The grid 1 and the grid wires 4 are connected to each other through bonding wires 5 and so are the semiconductor element 2 and the grid wires 4.

Since an iron.nickel.chromium alloy is used as a material for the grid 1, wire bonding cannot be directly performed. Therefore, as shown in FIG. 6B, an aluminum coat 6 must be formed in advance on the surface of an end portion of each grid element by sputtering, ion plating, vacuum deposition, or the like so as to allow wire bonding.

As described above, in a chip-in glass fluorescent display panel having driving semiconductor elements incorporated in a vacuum envelope, the wire bonding method is used to electrically connect a grid and a grid driving semiconductor element to each other. However, in order to realize wire bonding with high reliability, it is essential that bonding be performed between elements of the same material. Therefore, an aluminum coat must be formed on the surface of an end portion of each grid element.

It is especially difficult to form an aluminum coat on a predetermined portion of each grid element of a grid used for a graphic fluorescent display panel, in consideration of handling of components and the like, because the grid is formed by etching a thin plate made of an iron.nickel.chromium alloy, resulting in a considerably high process cost.

SUMMARY OF THE INVENTION

It is an object of the present invention to provide an inexpensive chip-in glass fluorescent display panel which can be easily manufactured.

It is another object of the present invention to provide a chip-in glass fluorescent display panel in which a grid and a grid driving semiconductor element can be electrically connected to each other with high reliability.

In order to achieve the above objects, according to the present invention, there is provided a chip-in glass fluorescent display panel, comprising a glass substrate on which a predetermined display pattern is formed by using thin aluminum film wires, phosphor layers formed on the thin aluminum film wires, a plurality of grid elements formed at a predetermined pitch on the phosphor layers through a predetermined space to extend parallel each other, and having rectangular flat portions formed at end portions, the rectangular flat portions being in surface contact with a surface of the glass substrate and fixed thereto, a plurality of grid electrode terminals composed of aluminum terminals formed on the glass substrate to be respectively located adjacent to the flat portions of the grid elements, a grid driving semiconductor element mounted on the glass substrate and electrically connected to the grid electrode terminals, an anode driving semiconductor element mounted on the glass substrate and electrically connected to the thin aluminum film wires, and a plurality of metal strips, each having first and second L-shaped pawls at a distal end thereof, the first and second pawls being respectively in contact with and fixed to the flat portion of a corresponding one of the grid elements and the adjacent grid electrode terminal.

DESCRIPTION OF THE PREFERRED EMBODIMENTS

Figure 1:
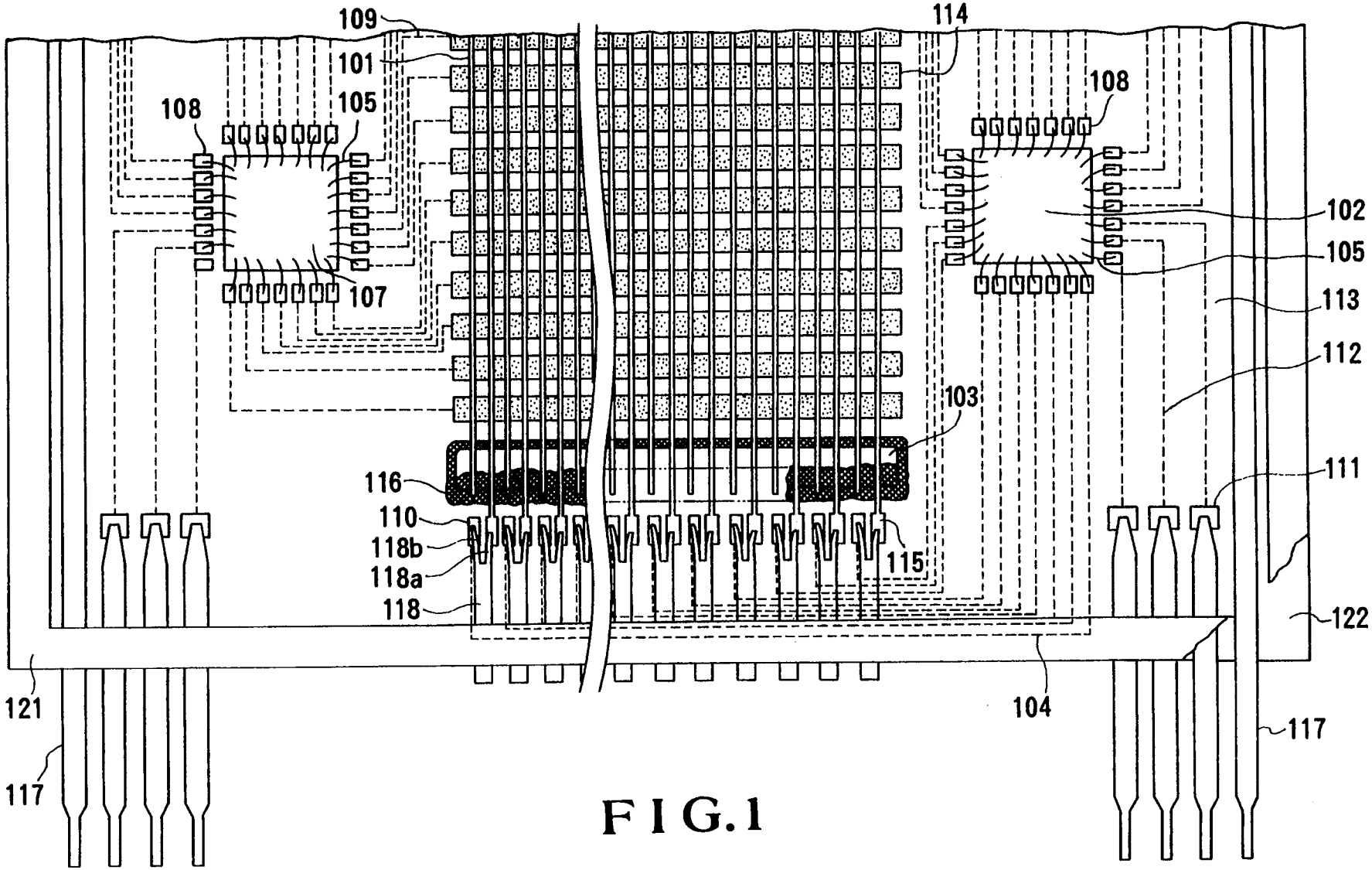
FIG. 1 is a plan view showing a chip-in glass fluorescent display panel according to the first embodiment of the present invention.
Figure 2:
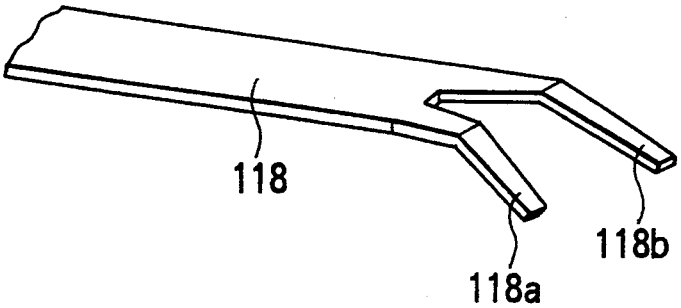
FIG. 2 is a perspective view of a metal strip used for the first embodiment.

The present invention will be described below with reference to the accompanying drawings. FIG. 1 shows the first embodiment of the present invention. FIG. 2 shows a metal strip used for the first embodiment. The following electrodes, electrode terminals, and wires are formed on a glass substrate 122 by sputtering and photolithography: linear anode electrodes (not shown) made of thin aluminum films and arranged at a predetermined pitch; anode wires 109 extending from the anode electrodes to bonding pads 108 of the mounting portion of an anode driving semiconductor element 107; grid electrode terminals 110; grid wires 104 extending from the electrode terminals 110 to bonding pads 108 of the mounting portion of a grid driving semiconductor element 102; predetermined extraction electrode terminals 111; and signal/power supply wires 112 extending from the predetermined extraction electrode terminals 111 to bonding pads 108 of the mounting portions of the two driving semiconductor elements 102 and 107.

An insulating layer 113 having a predetermined pattern of openings and the like was formed on the entire surface of the glass substrate 122 including the thin aluminum film wires by a thick-film print method.

Thereafter, segment electrodes (not shown), phosphor layers 114 each having a linear shape corresponding to the shape of each anode electrode, and a sealing frit glass layer (not shown) were formed on predetermined portions to constitute a display portion. Subsequently, a pair of glass spacers 103, each having a predetermined thickness, were placed parallel to the outermost phosphor layers 114 and were fixed on the glass substrate 122 with crystallized glass 116. Note that FIG. 1 shows only the glass spacer 103 on one side, and the phosphor layers 114 may have a dot-like shape.

A grid 101 was formed from a stainless steel plate having a thickness of 0.1 mm by photoetching to be constituted by linear portions arranged at a pitch of 0.8 mm, and rectangular flat portions 115 alternately formed on both ends of each linear portion. The grid elements of this grid 101 were supported on the glass spacers 103 to leave a space between the grid 101 and the glass substrate 122, and were caused to extend between the spacers 103 at right angles with respect to the linear phosphor layers 114. At the same time, the grid elements were arranged such that the rectangular flat portions 115 of the grid 101 were in surface contact with the glass substrate 122 and alternated with the grid electrode terminals 110. The grid 101 was fixed on the spacers 103 with the crystallized glass 116. In this embodiment, the patterns of the alternate rectangular flat portions 115 of the grid 101 and grid electrode terminals 110 are formed outside the outermost phosphor layers 114.

Subsequently, the anode driving semiconductor element 107 and the grid driving semiconductor element 102 were fixed on the predetermined mounting portions on the insulating layer 113 by die bonding. The two driving semiconductor elements 102 and 107 were connected to the surrounding bonding pads 108 through bonding wires 105, respectively.

Meanwhile, a frame having extraction leads 117 and metal strips 118, each having a distal end portion split into long and short portions as shown in FIG. 2, and allowing electrode parts and the like incorporated in the vacuum envelope to be mounted thereon was formed from a 426 alloy plate having a thickness of 0.3 mm by photoetching.

In this case, the leads 117 of the frame extend outward to the peripheral portion (not shown) of the frame to be continuous with each other. Similarly, the metal strips 118, each having a distal end strip into long and short portions, extend outward to the peripheral portion of the case to be continuous with each other. The extraction leads 117 and the pawls (see FIG. 2) of the distal end portions of the metal strips 118 are bent in the form of the letter "L" in the direction to come into contact with the respective electrodes. In addition, portions on which filaments and other electrode parts are to be mounted are shaped. The L-shaped distal ends of the extraction leads 117 are brought into contact with the extraction electrode terminals 111 on the glass substrate 122 from both sides thereof.

The upper surface of each rectangular flat portion 115 of the grid 101 is located above the glass substrate 122 by a distance corresponding to the sum of the thicknesses of the insulating layer 113 and the grid material itself. On the other hand, each grid electrode terminal 110 is formed on the glass substrate 122, while the insulating layer 113 having almost the same thickness as that of the grid electrode terminal 110 is formed therearound. Therefore, the difference in level between the upper surface of the flat portion 115 and the grid electrode terminal 110 becomes as large as about 0.1 to 0.2 mm. In order to absorb this level difference, the two pawls of each metal strip 118, which are to be respectively brought into contact with a corresponding one of the flat portions 115 and a corresponding one of the grid electrode terminals 110, need to have different lengths, and the distal ends of the two pawls must be located at different levels after they are bent. For this reason, as shown in FIG. 2, a short distal end **118*b* of each L-shaped, forked metal strip 118 was brought into contact with a corresponding one of the rectangular flat portions 115 of the grid end portions, while a long distal end 118*a* of the metal strip 118 was brought into contact with the grid electrode terminal 110 adjacent to the flat portion 115. Furthermore, electrode parts (not shown) were mounted at predetermined positions, and the metal strips 118 and the extraction leads 117 were simultaneously clamped between the glass substrate 122 and a cover glass 121**. The resultant structure was sealed at a temperature of about 450° C. by using a low-melting glass material. The structure was then evacuated.

After this process, the extraction leads 117 were cut off from the peripheral portion (not shown), at which they are continuous with each other, so as to be independent of each other. The metal strips 118 for grid electrode terminal connection were cut off from the peripheral portion at positions around the vacuum envelope so as to be independent of each other. With this process, a chip-in glass fluorescent display panel was completed.

According to the graphic type chip-in glass fluorescent display panel completed in this manner, the extraction leads 117 can be constituted by leads designed to only supply signals and power to the anode and grid driving semiconductor elements 107 and 102, and power to the filaments. Therefore, the panel can be easily mounted and used.

In addition, the L-shaped short distal end **118*a* of each forked metal strip is brought into contact with the rectangular flat portion of a corresponding one of the grid end portions, while the long distal end 118*b* of the metal strip is brought into contact with the electrode terminal adjacent to the rectangular flat portion, thereby realizing better electrical connection between the grid 101 and the grid driving semiconductor element 102. With this arrangement, wire bonding need not be used, unlike the prior art. Consequently, an additional process of forming an aluminum coat on the surface of each grid element of the grid 101** need not be performed, thus providing an inexpensive chip-in glass fluorescent display panel which can be easily manufactured.

Figure 3A:
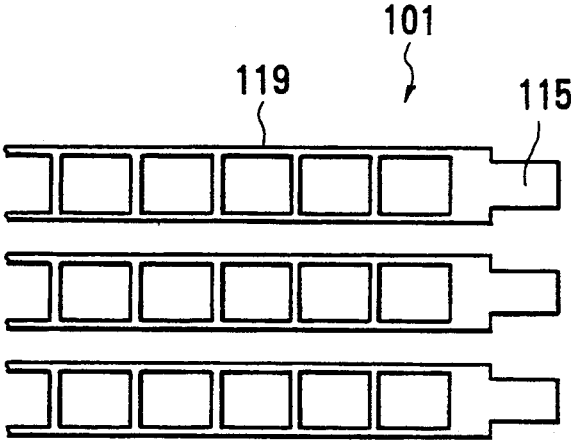
FIG. 3A is a plan view showing another arrangement of a grid portion in the first embodiment.

FIG. 3A shows another arrangement of a grid portion of the first embodiment. This grid 101 is formed from a stainless steel plate having a thickness of 0.1 mm by photoetching to have ladder-like portions 119 arranged at a pitch of 1.5 mm, and solid flat portions 115, each formed at one end portion of each ladder-like portion 119. In this structure, the width of each flat portion 115 is set to be slightly smaller than that of each ladder-like portion 119 so that the flat portions 115 neatly aligned with grid electrode terminals 110, respectively. Even by using such a grid, the same effects as those obtained by using the grid shown in FIG. 1 can be obtained.

Figure 4:
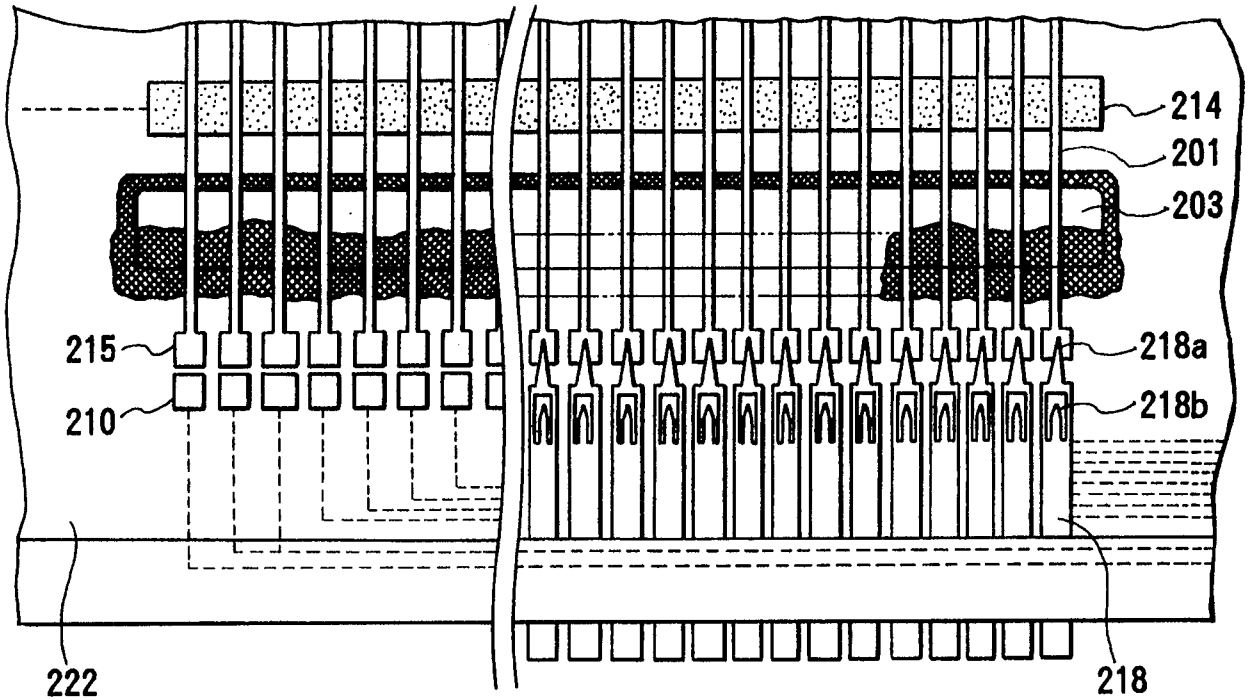
FIG. 4 is a plan view showing a main portion of a chip-in glass fluorescent display panel according to the second embodiment of the present invention.
Figure 5:
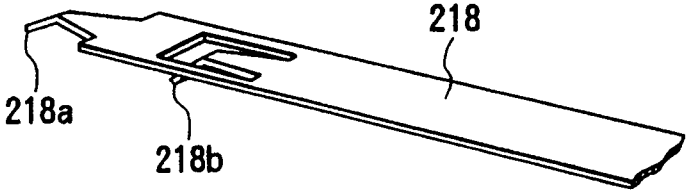
FIG. 5 is a perspective view of a metal strip used for the second embodiment.
Figure 6A:
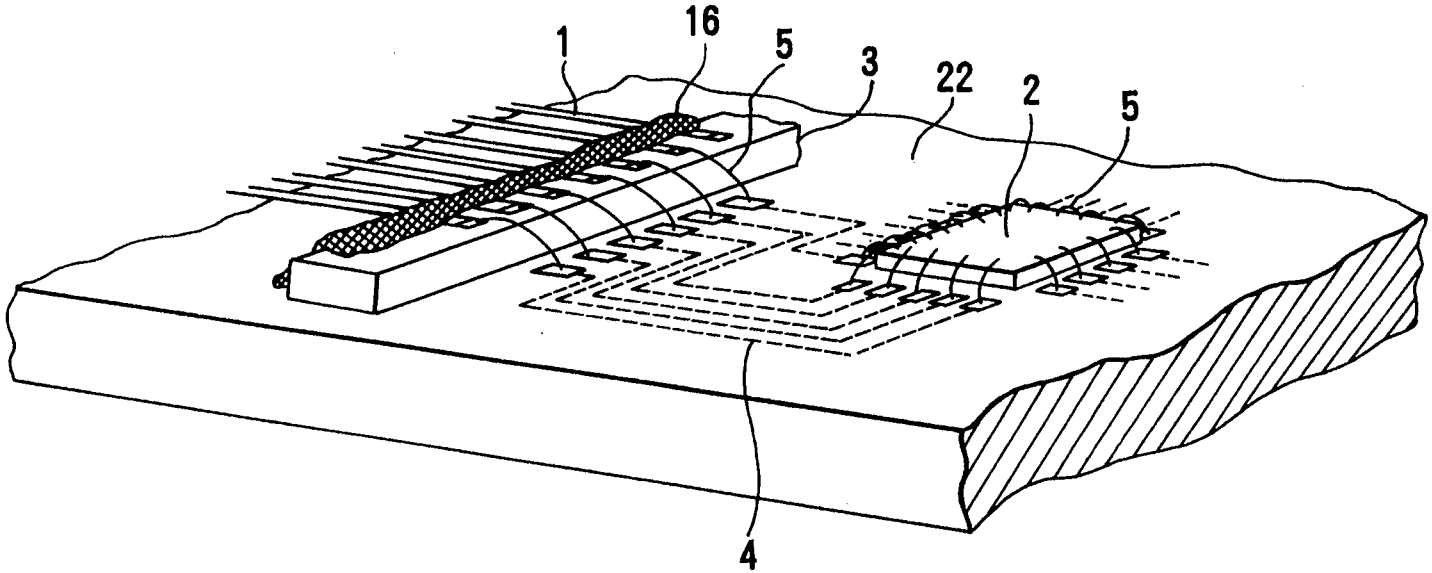
FIG.6A PRIOR ART
FIG. 6A is a perspective view of a conventional chip-in glass fluorescent display panel, showing the connection state between a grid and a grid driving semiconductor element.
Figure 6B:
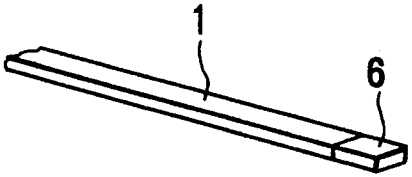
FIG.6B PRIOR ART
FIG. 6B is a perspective view of a conventional grid portion.

FIG. 4 shows a connecting portion between a grid and grid electrode terminals in the second embodiment of the present invention. FIG. 5 shows a metal strip used for the second embodiment. The first and second embodiments have the following two different points. First, rectangular flat portions 215 of a grid 201 and grid electrode terminals 210 are arranged parallel to each other outside only one outermost phosphor layer 214 so as be adjacent to each other instead of alternately arranging the flat portions 215 and the grid electrode terminals 210 outside the two outermost phosphor layers 214. Second, each L-shaped metal strip 218 in the second embodiment differs in shape from each metal strip in the first embodiment. More specifically, as shown in FIG. 5, each metal strip 218 in the second embodiment has a first pawl 218*a* whose distal end is bent into an L shape, and a second pawl 218*b* partially cut and bent into an L shape inwardly so as to separate from the distal end by a predetermined distance. From one side of a glass substrate 222, the first pawls 218*a* are brought into contact with the flat portions 215 of the grid 201, while the second pawls 218*b* are brought into contact with the grid electrode terminals 210 adjacent to the respective flat portions 215, thereby electrically connecting the grid 201 to a grid driving semiconductor element 212. Note that since each second pawl 218*b* is brought into contact with a corresponding one of the grid electrode terminals 210 on the glass substrate 222, the length of each second pawl 218*b* is set to be longer than that of each first pawl 218*a*. Reference numeral 213 denotes a glass spacer.

Figure 3B:
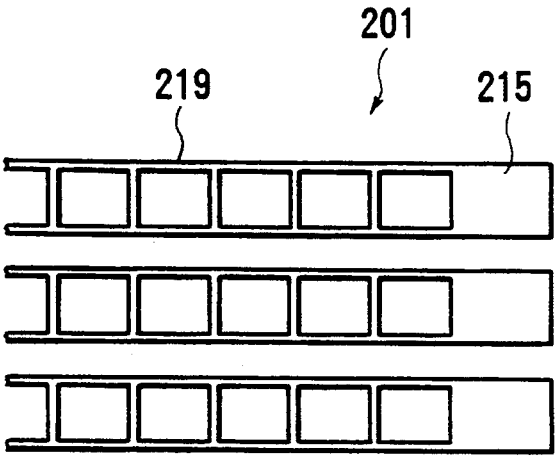
FIG. 3B is a plan view showing another arrangement of a grid portion in the second embodiment.

FIG. 3B shows another arrangement of a grid portion in the second embodiment. The grid portions shown in FIGS. 3A and 3B have the following different point. In the second embodiment, since the flat portions 215 of the grid 201 and the grid electrode terminals 210 need not be alternately arranged, the arrangement in FIG. 3B has a wider margin than that in shown in FIG. 3A in terms of space. Therefore, the width of each flat portion 215 is set to be equal to that of each ladder-like portion 219 in the arrangement shown in FIG. 3B.

As has been described above, according to the present invention, ladder-like or linear portions are formed at a predetermined pitch, and grid elements having flat portions at their end portions are formed. Each of the distal end portions of metal strips is split into long and short portions, each of which is bent into an L shape. The short portion of each metal stripe is brought into contact with the rectangular flat portion of a corresponding one of the grid end portions, while the long portion of each metal strip is brought into contact with the grid electrode terminal adjacent to the grid end portion. With this structure, the grid and a grid driving semiconductor element can be electrically connected to each other. Accordingly, the wire bonding method need not be used to electrically connect the grid and the grid driving semiconductor element, unlike the prior art. Therefore, an additional process of forming an aluminum coat on the surface of each grid element need not be performed, and an inexpensive chip-in glass fluorescent display panel which can be easily manufactured can be provided.

In addition, the upper surface of the rectangular flat portion of each grid end portion is different in level from each grid electrode terminal. In order to absorb this level difference, the pawls of each metal strip, which are to be brought into contact with the upper surface of each flat portion and each grid electrode terminal, must have different lengths, and the distal ends of the two pawls must be located at different levels after they are bent. For this reason, the short and long distal end portions, of each forked metal strip, each of which is bent into an L shape, are respectively brought into contact with the rectangular flat portion of a corresponding grid end portion and the adjacent grid electrode terminal, thereby allowing better electrical connection between the grid and the grid driving semiconductor element.

Furthermore, metal strips are formed such that each strip has a first pawl whose distal end portion is bent into an L shape, and a second pawl partially cut and bent into an L shape inwardly so as to separate from the distal end by a predetermined distance. The first and second pawls of each metal strip are respectively brought into contact with the rectangular flat portion of each grid end portion and the adjacent grid electrode terminal on a glass substrate. With this structure, since the first and second pawls of each metal strip are located on the extended line of a corresponding grid element and dot not expand laterally, metal strips can be arranged on one side even if the pitch of the grid elements is small.

What is claimed is:

1. A chip-in glass fluorescent display panel, comprising:

a glass substrate on which a predetermined display pattern is formed by using thin aluminum film wires;

phosphor layers formed on said thin aluminum film wires;

a plurality of grid elements formed at a predetermined pitch on said phosphor layers through a predetermined space to extend parallel to each other, and having rectangular flat portions formed at end portions, said rectangular flat portions being in surface contact with a surface of said glass substrate and fixed thereto;

a plurality of grid electrode terminals composed of aluminum terminals formed on said glass substrate to be respectively located adjacent to the flat portions of said grid elements;

a grid driving semiconductor element mounted on said glass substrate and electrically connected to said grid electrode terminals;

an anode driving semiconductor element mounted on said glass substrate and electrically connected to said thin aluminum film wires;

a plurality of metal strips, each having first and second L-shaped pawls at a distal end thereof, the second pawl of each of said metal strips being longer than the first pawl thereof, and further the first and second pawls of said metal strips being clamped between said glass substrate and a cover glass and being fixed with low-melting glass, said first and second pawls being respectively in contact with and fixed to the flat portion of a corresponding one of said grid elements and said adjacent grid electrode terminal.

2. A panel according to claim 1, wherein said grid electrode terminals are respectively arranged between the respective adjacent flat portions of said grid elements, and a distal end portion of each of said metal strips is split into two portions to form said first and second pawls.

3. A panel according to claim 2, wherein the flat portions of said grid elements are alternately arranged outside two outermost phosphor layers of said phosphor layers, and said grid electrode terminals are arranged near the flat portions of said grid elements outside said outermost phosphor layers.

4. A panel according to claim 1, wherein each of said grid electrode terminals is arranged on an extended line of the flat portion of each of said grid elements, each of said metal strips has the first pawl formed at a distal end portion and the second pawl partially cut and bent inwardly so as to separate from the distal end portion by a predetermined distance.

5. A panel according to claim 4, wherein the flat portions of said grid elements are continuously arranged outside one outermost phosphor layer of said phosphor layers, and said grid electrode terminals are arranged near the flat portions of said grid elements outside said outermost phosphor layer.

6. A panel according to claim 1, wherein the second pawl of each of said metal strips is longer than the first pawl thereof.

7. A panel according to claim 1, wherein each of said grid elements has a linear shape, and the flat portion is formed at one end portion of said grid element.

8. A panel according to claim 1, wherein each of said grid elements has a ladder-like shape, and the flat portion narrower than the ladder-like portion is formed at one end portion of said grid element.

9. A panel according to claim 1, wherein each of said grid elements has a ladder-like shape, and the flat portion having the same width as that of the ladder-like portion is formed at one end portion of said grid element.

10. A chip-in glass fluorescent display panel, comprising:

a glass substrate on which a predetermined display pattern is formed by using thin aluminum film wires;

phosphor layers formed on said thin aluminum film wires;

a plurality of grid elements formed at a predetermined pitch on said phosphor layers through a predetermined space to extend parallel to each other, each of said grid elements having a linear shape and a rectangular portion formed at one end portion of said grid element, said rectangular flat portions being in surface contact with a surface of said glass substrate and fixed thereto;

a plurality of grid electrode terminals composed of aluminum terminals formed on said glass substrate, said grid electrode terminals being respectively arranged and located adjacent to and between respectively adjacent flat portions of said grid elements;

a grid driving semiconductor element mounted on said glass substrate and electrically connected to said grid electrode terminals;

an anode driving semiconductor element mounted on said glass substrate and electrically connected to said thin aluminum film wires; and a plurality of metal strips, a distal end portion of each of said metal strips being split into two portions to form first and second pawls, each of said first and second pawls being L-shaped pawls at said distal end of said metal strips, the second pawl of each of said metal strips being longer than the first pawl thereof, said first and second pawls being respectively in contact with and fixed to the flat portion of a corresponding one of said grid elements and said adjacent grid electrode terminal.

11. A chip-in glass fluorescent display panel, comprising:

a glass substrate on which a predetermined display pattern is formed by using thin aluminum film wires;

phosphor layers formed on said thin aluminum film wires;

a plurality of grid elements formed at a predetermined pitch on said phosphor layers through a predetermined space to extend parallel to each other, each of said grid elements having a linear shape and a rectangular flat portion formed at one end portion of said grid element, said rectangular flat portions being in surface contact with a surface of said glass substrate and fixed thereto;

a plurality of grid electrode terminals composed of aluminum terminals formed on said glass substrate to be respectively located adjacent to the flat portions of said grid elements, each of said grid electrode terminals being arranged on an extended line of the flat portion of each of said grid elements;

a grid driving semiconductor element mounted on said glass substrate and electrically connected to said grid electrode terminals;

an anode driving semiconductor element mounted on said glass substrate and electrically connected to said thin aluminum film wires; and a plurality of metal strips, each of said strips having first and second L-shaped pawls at a distal end thereof which are partially cut and bent inwardly so as to be separated from the distal end portion by a predetermined distance, the second pawl of each of said metal strips being longer than the first pawl thereof, said first and second pawls being respectively in contact with and fixed to the flat portion of a corresponding one of said grid elements and said adjacent grid electrode terminal.

12. A panel according to claim 1, wherein the first and second pawls of said metal strips are clamped between said glass substrate and a cover glass and are fixed with low-melting glass while the first and second pawls are respectively in contact with the flat of said grid elements and said grid electrode terminals.

* * * * *